US011845999B2

(12) United States Patent
Itofuji et al.

(10) Patent No.: US 11,845,999 B2
(45) Date of Patent: Dec. 19, 2023

(54) METHOD FOR PRODUCING DIE-CAST PRODUCT OF SPHERICAL GRAPHITIC CAST IRON INCLUDING ULTRAFINE SPHERICAL GRAPHITE, AND SPHEROIDIZING TREATMENT AGENT

(71) Applicants: I2C CO., LTD, Yamaguchi (JP); TOHOKU UNIVERSITY, Miyagi (JP)

(72) Inventors: Haruki Itofuji, Yamaguchi (JP); Masayuki Itamura, Yamaguchi (JP)

( * ) Notice: Subject to any disclaimer, the term of this patent is extended or adjusted under 35 U.S.C. 154(b) by 0 days.

(21) Appl. No.: 17/548,542

(22) Filed: Dec. 12, 2021

(65) Prior Publication Data

US 2022/0106652 A1 Apr. 7, 2022

Related U.S. Application Data

(62) Division of application No. 16/498,192, filed on Nov. 6, 2019, now abandoned.

(30) Foreign Application Priority Data

Mar. 29, 2017 (JP) ..... 2017-065474
Mar. 29, 2018 (WO) ..... PCT/JP2018/013239

(51) Int. Cl.
*C21C 1/10* (2006.01)

(52) U.S. Cl.
CPC ..... *C21C 1/10* (2013.01)

(58) Field of Classification Search
CPC ..... C21C 1/10; C21C 1/105; C22C 33/10; C22C 37/04; C22C 37/10; C22C 38/002; C22C 38/02; C22C 38/04
See application file for complete search history.

(56) References Cited

FOREIGN PATENT DOCUMENTS

| | | | | |
|---|---|---|---|---|
| CN | 1558804 | A | | 12/2004 |
| CN | 103525969 | A | * | 1/2014 |
| CN | 103525969 | A | | 1/2014 |
| CN | 105039835 | A | | 11/2015 |
| JP | 07-242987 | A | | 9/1995 |
| JP | 2006-063396 | A | | 3/2006 |
| WO | 2017/010569 | A1 | | 1/2017 |

OTHER PUBLICATIONS

ISR: Japanese Patent Office; dated May 15, 2018.
Itofuji, Haruki et al.; Journal of the Reports of The Japan Foundry Engineering Society Meeting), May 2015.

* cited by examiner

*Primary Examiner* — Jenny R Wu
(74) *Attorney, Agent, or Firm* — Patshegen IP; Moshe Pinchas

(57) ABSTRACT

The present invention provides a die-cast product producing method and a spheroidizing agent of a spherical graphite cast iron with ultrafine spherical graphite by simple method and good reproducibility.

The present invention provides a sand mold producing method and a spheroidizing agent capable of producing an ultrafine spherical graphite cast iron with good reproducibility even in a sand mold thin walled spherical graphite cast iron, which has solidification cooling conditions equivalent to those of a metal mold.

The present invention provides a producing method of a die-cast product of a spherical graphite cast iron using a spheroidizing agent, in which a C amount is 0.5 mass % or more, a total nitrogen amount N is 150 ppm (by mass) or less, and a nitrogen amount generated during melting is 15 ppm (by mass) or less, in a producing method of a sand mold cast product of a thin walled spherical graphite cast iron having a melting process, a spheroidizing process, an inoculation process, and a casting process.

3 Claims, 3 Drawing Sheets

Base tissue; ferrite≒95% + perlite≒5%,
Graphite 1,963 particles/mm$^2$

A. Graphite tissue of metal mold casting obtained with low nitrogen (N) content spheroidizing agent Base tissue; ferrite≒30% + ledeburite≒70%,
Graphite 760 particles/mm$^2$ B. Graphite tissue of metal mold casting obtained with high nitrogen (N) content spheroidizing agent Base tissue; ferrite 60% + perlite 40%,
Graphite 2,905 particles/$mm^2$ Example 2 Graphite tissue of metal mold casting obtained with low nitrogen (n) content spheroidizing agent

FIG. 3

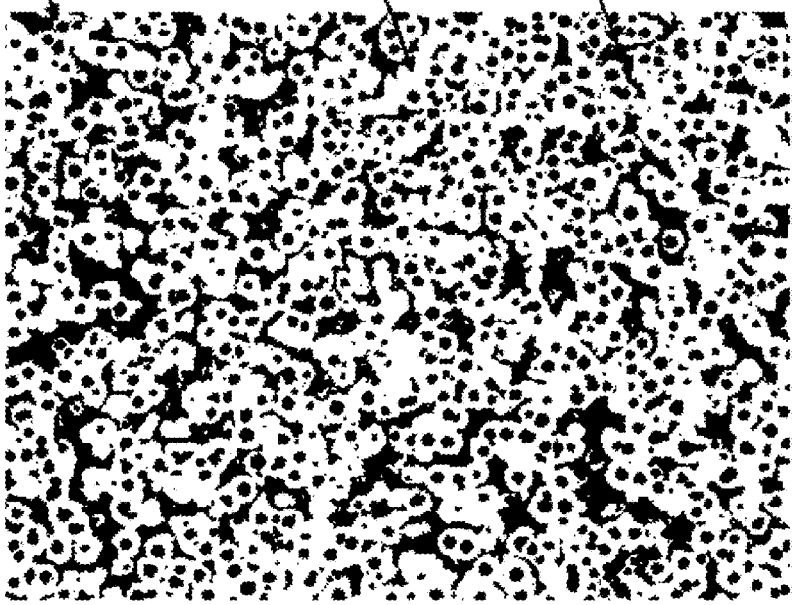

Base tissue; ferrite≒80% + perlite≒20%,
Graphite 853 particles/mm$^2$

A. Graphite tissue of sand mold thin walled casting obtained with low nitrogen (N) content spheroidizing agent

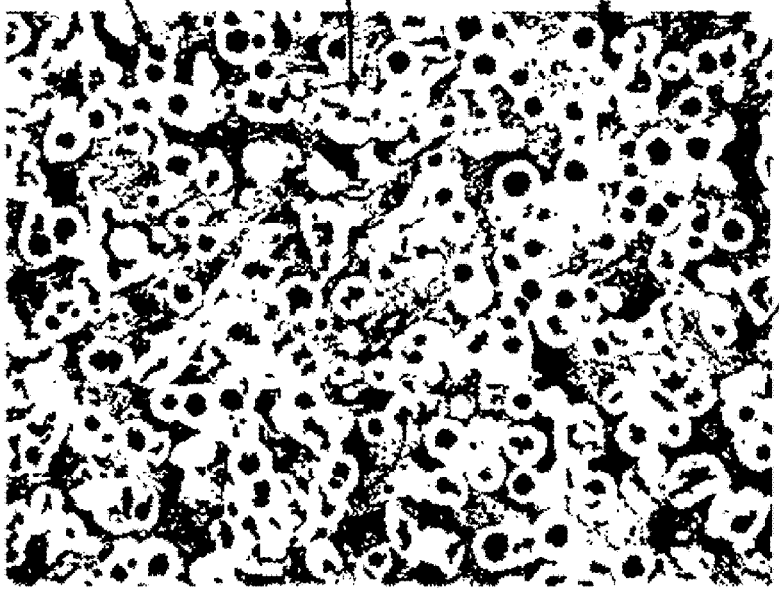

Base tissue; ferrite≒50% + perlite≒25% + ledeburite≒25%,
Graphite 187 particles/mm$^2$ B. Graphite tissue of sand mold thin walled casting obtained with high nitrogen (N) content spheroidizing agent

METHOD FOR PRODUCING DIE-CAST PRODUCT OF SPHERICAL GRAPHITIC CAST IRON INCLUDING ULTRAFINE SPHERICAL GRAPHITE, AND SPHEROIDIZING TREATMENT AGENT

TECHNICAL FIELD

The present invention relates a producing method of die-cast product of spherical graphite cast iron including ultrafine spherical graphite, and a spheroidizing agent.

BACKGROUND ART

The spherical graphite cast iron is a kind of pig iron casting (Another name: cast iron), and also called ductile cast iron. In the case of a gray cast iron, which is a kind of cast iron, graphite has a thin strip shape having a strong elongated anisotropy. In contrast, in the case of the spherical graphite cast iron, graphite has a spherical shape. The spherical graphite is obtained by adding a graphite spheroidizing agent containing magnesium, calcium and the like to the molten metal just before casting.

Because graphite without strength is spherical and independent in the spherical graphite cast iron, this casting is tenacious and tough as much as steel. Ductile means toughness, and spherical graphite is responsible for properties with material strength and elongation. Currently, it is widely used as a material for industrial equipment including the automobile industry.

As the graphite is fine and its particle number increases, the effect of inhibiting crack propagation at the time of impact is enhanced and the impact energy increases. Efforts have been made to miniaturize and uniformly disperse the spherical graphite for the purpose of further improving the material.

In the general metallographic structure of conventional spherical graphite cast iron, it is common to have spheroidal graphite of at most 400 pieces/mm$^2$, and usually around 100 pieces/mm$^2$.

On the other hand, the present inventors separately provide an ultrafine spherical graphite cast iron having a structure containing spheroid graphite much more than 400 pieces/mm2 and having no occurrence of a chill, and a producing method of the same. That is, die-cast product of ultra-fine spherical graphite cast iron, which has a chill-free as-cast state and a structure containing more than 1,000 pieces/mm$^2$ and more than 3,000 pieces/mm$^2$ of spherical graphite in an as cast state, and its producing method are provided (Patent Document 1).

PRIOR ART DOCUMENTS

Patent Documents

Patent Document 1 PCT/JP2016/071036

DISCLOSURE OF THE INVENTION

Problems to be Solved by the Invention

In the technology described in the Patent Document 1, the above-mentioned ultra-fine spherical graphite cast iron is realized by controlling the amount of nitrogen so that the nitrogen amount generated during melting of die-cast product is 0.9 ppm (by mass) or less. And in the example, nitrogen is purged from an original molten metal by controlling the temperature of the original molten metal, and the nitrogen amount generated during melting before casting into the die-cast product is controlled to become 0.9 ppm (by mass) or less.

However, in the next spheroidizing process, because an Mg alloy, which is a spheroidizing agent, contains nitrogen, the nitrogen amount generated during melting of the molten metal before casting may not necessarily be 0.9 ppm (by mass) or less.

The present invention provides a producing method of a die-cast product of spherical graphite cast iron having ultrafine spherical graphite capable of producing ultrafine spherical graphic cast iron with simple method and good reproducibility, and a spheroidizing agent.

Solutions for Solve the Problems

The invention includes

- a producing method of a die-cast product of a spherical graphite cast iron comprised from;
- a melting process, in which raw material comprising cast iron is melted by heating and an original molten metal is obtained;
- a spheroidizing process, in which a spheroidizing is carried out;
- an inoculation process, in which an inoculation is carried out; and
- a casting process, in which a casting in a metal mold is carried out;
- wherein the spheroidizing is carried out by using a spheroidizing agent, in which a C amount is 0.5 mass % or more, a total nitrogen amount N is 150 ppm (by mass) or less, and a nitrogen amount generated during melting is 15 ppm (by mass) or less.

Total nitrogen amount=nitrogen amount generated during melting+nitride amount

The spheroidizing agent can be a Fe—Si—Mg-based spheroidizing agent.

The nitrogen amount generated during melting of the die-cast product can be controlled to 5 ppm (by mass) or less.

The method can further includes raw material comprising cast iron is melted by heating and an original molten metal is obtained, the original molten metal is heated to a predetermined temperature of 1,500° C. or higher, heating is stopped and the original molten metal is hold at the predetermined temperature for a certain time to remove oxygen from the original molten metal, the original molten metal is gradually cooled to reduce nitrogen in the original molten metal, and the spheroidizing, the inoculation and the casting are carried out.

The spheroidizing agent can include a C amount is 0.5 mass % or more, a total nitrogen amount N is 150 ppm (by mass) or less, and a nitrogen amount generated during melting is 15 ppm (by mass) or less.

The spheroidizing agent can be a Fe—Si—Mg-based spheroidizing agent.

Effects of the Invention

According to the present invention, it is possible to produce a chill-free ultra-fine spherical graphite cast iron with simple method and good reproducibility.

As a result of intensive research, the present inventors considered that nitrogen in the spheroidizing agent as well as nitrogen in the original molten metal may greatly affect the chilling, and repeated experiments. And, the inventors have found that it is possible to prevent the generation of chill and achieve micro-spheroidization while reducing the nitrogen amount in the original molten metal more than in the Patent Document 1. It is speculated that N in the spheroidizing agent, especially free N among its N forms, affects chilling as well as free N in the original molten metal. Therefore, in the present invention, micro-spheroidization and no chilling are achieved even when a nitrogen amount generated at melting exceeds 0.9 ppm, so the procedure for controlling the amount of nitrogen in the original molten metal is reduced. As a result, it becomes possible to produce ultrafine spherical graphite cast iron with simple method and good reproducibility.

BRIEF DESCRIPTION OF THE DRAWINGS

FIG. 1A relates to the Example 1, and FIG. 1B relates to the comparative example.

FIG. 3 shows photographs showing a metallographic diagram in Example 3 and its comparative example. FIG. 3A relates to the Example 3, and FIG. 3B relates to the comparative example.

MODE FOR CARRYING OUT THE INVENTION

Figure 1:
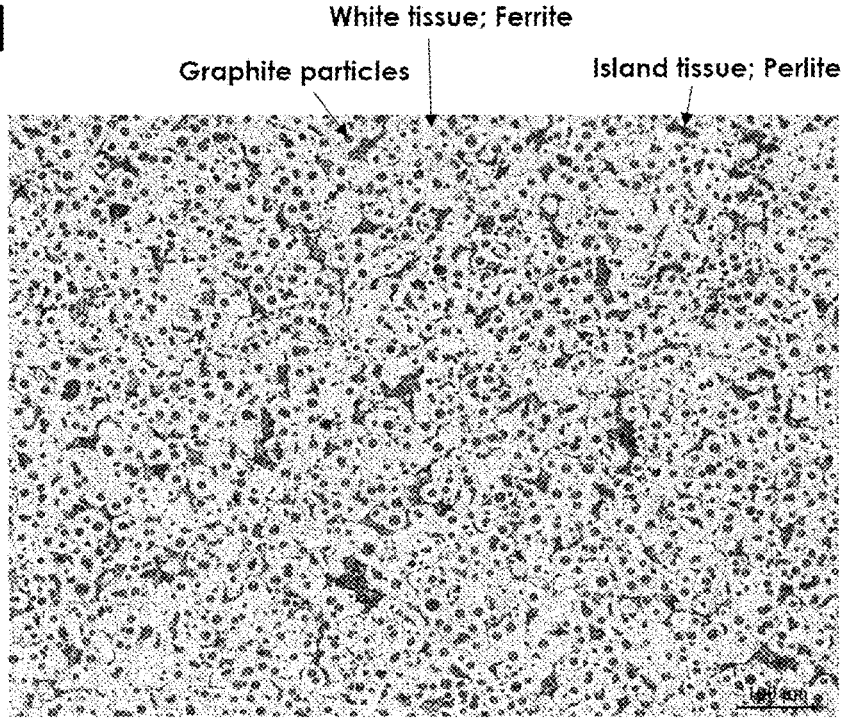
FIG. 1 shows photographs showing a metallographic diagram in Example 1 and its comparative example.
Figure 1:
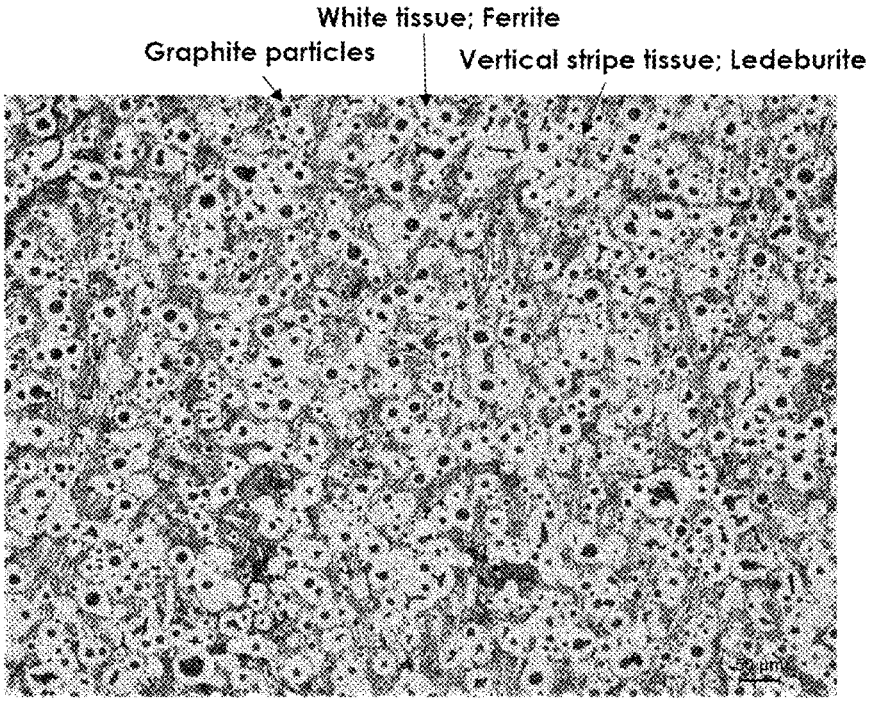

A mode for carrying out the present invention is described in every process.

(Melting Process)

In a melting process, raw material, which become an original molten metal, of spherical graphite cast iron are melted.

As the above raw material, for example, raw materials of "Chemical composition" of the corresponding international standard ISO1083 specified in JIS G 5502 Annex may be used. Table 1 shows an example of the composition defined in "Table A. 2 Example of chemical composition" as an example.

TABLE A

| 2-Example of chemical composition | | | | | | |
|---|---|---|---|---|---|---|
| C % Approx. | Si % Approx. | Mn % max | P % max | S % max | Mg % Approx. | Cu % max |
| 3.3 | 3.7 | 0.3 | 0.05 | 0.02 | 0.04 | 0.1 |

(International standard ISO1083)

Other cast irons are also applicable. Moreover, another element may be added as needed. In addition, the composition range may be appropriately changed.

As examples specified in JIS G 5502, FCD400-15, FCD450-10, FCD500-7, FCD600-3, FCD700-2, FCD800-2 and the like can be shown.

In addition to the above components, Bi, Ca, Ba, Cu, Ni, Mo, RE (rare earth element) may be appropriately added to the raw material of the original molten metal or after the raw material is dissolved.

And, CE (carbon equivalent) may be appropriately controlled to, for example, 3.9 to 4.6.

In the present invention, a spheroidizing is carried out after the melting.

However, in another embodiment of the present invention, a heating is carried out after the melting to raise the temperature of the original molten metal. By raising the temperature, oxygen is removed from the inside of the original molten metal.

The temperature is raised until the time, when the removal of oxygen (reduction of $SiO_2$) from the inside of the original molten metal stops. The raised temperature $T_0$ in consideration of the work efficiency is approximately 1,500° C. When the temperature is reached to the above, the temperature rising is stopped, and the temperature is kept at $T_0$ for a predetermined time. When the temperature is kept, the generation of air bubbles is observed from the side of the crucible. This is a phenomenon, in which the reduction of $SiO_2$ in the original molten metal stops and the lining $SiO_2$ of the melting furnace begins to be reduced and eroded. Therefore, the keeping temperature is stopped at that time. Usually, the keeping temperature takes place between 2 and 10 minutes. After the process of removing oxygen, a removing nitrogen is carried out. At that time, a nitrogen amount generated at the time of melting should be a predetermined value.

The nitrogen amount generated at the time of melting is an amount of nitrogen gas at the time of melting when the cast sample is melted. Specifically, it is measured according to the following procedures. To remove the oxide film of the cast sample, the oxide film on the surface is removed by FUJI STAR 500 (Sankyo Rikagaku) sandpaper until metallic luster is obtained, and the cast product is cut with a micro cutter or a reinforcing bar cutter to obtain 0.5-1.0 g of samples. The cut samples are washed with acetone for oil removal, dried for several seconds with a dryer or vacuum dried, and then analyzed.

In beginning of the analysis, power is supplied to an equipment, He gas is sent, system check and leak check are carried out, and it is confirmed that there is no abnormality. After stabilization, analysis is started. For analysis, discard analysis and blank measurement are carried out to carry out zero point correction.

For the blank measurement, a crucible is firstly set. About 0.4 g of a combustion improver (graphite powder) is added (The purpose of the combustion improver improves the nitrogen extraction rate in the alloy). Outing gas and purging are carried out while introducing He gas, and an interior of a sample chamber is replaced with He gas. Next, In order to remove oxygen and nitrogen generated from the graphite crucible by preliminary heating, heat is maintained for 15 seconds at an analysis temperature (2,163° C.) or higher to remove gas generated from the crucible. Thereafter, analysis is carried out under heating condition, and numerical value obtained is set to blank and correction is carried out so as to be a zero point base.

As standard samples for preparing calibration curve, LECO 114-001-5 (8±2 ppm nitrogen, 115±19 ppm oxygen), 502-873 (47±5 ppm nitrogen, 35±5 ppm oxygen), 502-869 (414±8 ppm nitrogen, 36±4 ppm oxygen) and 502-416 (782±14 ppm nitrogen, 33±3 ppm oxygen) are used. Measurements are carried out three times for each sample, and a calibration curve is prepared from the obtained numerical values.

In the temperature elevation analysis, it slowly dissolves from the low melting point material, and nitrogen contained in the melted material is extracted for each temperature, and a wave peak is obtained.

A nitrogen amount per unit area are calculated from a total area of wave peak (sum of peak intensity value) and a nitrogen amount obtained by analysis, and a peak (A1)

generated at an initial temperature rise around 1,250-1,350° C. is quantified as a nitrogen amount at melting.

About the nitrogen, it can be removed from the original molten metal by decreasing the solubility in the original molten metal. For this purpose, the molten metal is slowly cooled. In the case of rapid cooling, nitrogen may not be completely removed from the original molten metal. The cooling rate is preferably 5° C./min or less.

The cooling is preferably carried out to T (° C.) in the equation 1. When the cooling is carried out to a temperature lower than T (° C.), oxygen consumption starts on the contrary. It is preferable to cool down to T <° C.> in order to minimize both nitrogen and oxygen. It is preferable to cool to (T−15° C.)±20(° C.) in consideration of the practical viewpoint, with respect to the equation 1 derived from equilibrium theory.

$$T=T_k-273(^\circ\ \mathrm{C.})$$

$$\log([\mathrm{Si}]/[\mathrm{C}]^2)=-27.486/\mathrm{Tk}+15.47 \qquad \text{Equation 1}$$

In the slow cooling process, nitrogen is released from the original molten metal. That is, since the saturated solubility of nitrogen in the original molten metal decreases by slow cooling, nitrogen, which has not formed a compound with other elements, is released from the original molten metal. In addition, bubbling by argon gas may be carried out, for example. Such cooling removes nitrogen from the original molten metal.

(Spheroidizing Process)

A spheroidizing is carried out after the melting process.

In the present invention, the spheroidizing is carried out using a spheroidizing agent, in which a C amount is 0.5 mass % or more, a total nitrogen amount N is 150 ppm (by mass) or less, and the nitrogen amount generated during melting is 15 ppm (by mass) or less.

From the viewpoint of easiness of control, the lower limit of the nitrogen amount N generated during melting is preferably 3 ppm.

In the present invention, the spheroidizing agent contains the C amount of 0.5% or more. Only when 0.5% or more of C is contained, the nitrogen amount N generated during melting can be controlled to 20 ppm or less. The upper limit of C amount is about 2.20% by mass because Fe-50% Si by mass is the base.

The spheroidizing is generally carried out by adding Mg. Other methods (for example, spheroidizing with a treatment agent containing Ce) may be used. However, in the case of Mg, the degree of refinement and the number of spheroidized carbon per unit are overwhelmingly superior, compared to Ce. Further, excessive Ce amount is not preferable because it causes chill induction.

The spheroidizing agent containing Mg is preferably Fe—Si—Mg. In particular, it is preferable to use the spheroidizing agent of Fe:Si:Mg=50:50:(1 to 10) (by mass ratio). When the Mg ratio is less than 1, sufficient spheroidizing cannot be carried out. On the other hand, if it exceeds 10, the vaporization pressure of Mg as an alloy becomes high, foaming during spheroidizing becomes intense, and absorption of N gas is caused. From this viewpoint, 1 to 10 is preferable, and 1 to 5 is more preferable.

It is preferable to carry out the spheroidizing when the oxygen amount of the original molten metal is 20 ppm (by mass) or less. Fine spherical graphite can be obtained by controlling the oxygen amount to 20 ppm or less.

(Inoculation Process)

After the spheroidizing treatment, an inoculation is immediately carried out. The inoculation is carried out by adding, for example, a Fe—Si inoculum containing a small amount of elements (Ca, Ba, Al, etc.) having a strong affinity for N to the molten metal. For example, a Fe-75Si (by mass ratio) is preferably used.

(Casting Process)

After adding inoculum Fe—Si, a casting is carried out. The casting is preferably carried out in a state where the inoculum does not diffuse and does not become uniform. It is preferable to shorten the time to, for example, 10 minutes or less, 5 minutes or less, 1 minute or less, or 5 seconds or less, in consideration of facility factors and the like.

The casting is preferably carried out at $T_p$±20(° C.).

$$T_p=1{,}350\cdot 60M(^\circ\ \mathrm{C.})$$

$$M=V/S$$

V is product volume ($cm^3$), S is product surface area ($cm^2$)

The metal mold temperature is preferably $T_d$±20(° C.).

$$T_d=470-520M(^\circ\ \mathrm{C.})$$

$$M=V/S$$

V is product volume ($cm^3$), S is product surface area ($cm^2$)

It is preferable to control the metal mold temperature according to the volume of the product. Spherical graphite can be formed more finely and uniformly by controlling the metal mold temperature.

However, depending on the conditions, there is a fear of causing poor molten metal circulation, so the minimum temperature of the metal mold is preferably 100° C.

(Inoculation)

The purpose of the inoculation is to make harmless against chill generation by making free N into nitride, and to increase the number of graphite crystallization sites by maintaining Si concentration spots.

The inoculation treatment is preferably carried out by adding a Fe—Si inoculum containing a small amount of an element (Ca, Ba, Al, Sr and Zr etc.) having a strong affinity for N.

Casting is preferably carried out as soon as possible after the addition of the Fe—Si. As the time from the inoculation to the casting becomes shorter, the risk of chill generation becomes lower, the spherical graphites become finer, and number of the spherical graphites per unit area increases. As the time becomes shorter, the less the diffusion of the Fe—Si into the molten metal decreases, and the density of the spherical graphite becomes high.

Although depending on the apparatus and the like, for example, the casting is preferably carried out within 10 minutes, more preferably within 5 minutes, and further preferably within 30 seconds and within 5 seconds. When casting is carried out in a state where the Fe—Si-based inoculum is dissolved and before diffusion, the number of spheroidal graphites is dramatically increased as compared with the case where the Fe—Si-based inoculum is dissolved uniformly. The molten metal, from which free N is removed with a small amount of elements such as Ca, Ba, and Al etc., can suppress the risk of chill generation by minimizing the amount of free N, which is newly absorbed during the time until casting. In order to further promote such a state, it is preferable to carry out the casting without the stirring.

A par value of the nitrogen amount N generated at the time of melting can be kept low by the selection of the melting method of the original molten metal, the spheroidizing agent and the inoculum. However, it absorbs the nitrogen amount N generated during melting because foaming during Mg reaction, the surface area that comes into contact with the atmosphere increases due to thinning of the stream during tapping and pouring, and a coating binder contains nitrogen. Removing free N by the inoculation is possible, but the nitrogen amount N generated during melting into the metal mold product is preferably 5 ppm (by mass) or less, more preferably 3 ppm (by mass) or less and 1 ppm (by mass) or less.

A coating mold is preferably applied to the metal mold. Specifically, a heat insulating coating mold is preferable, and a coating mold, whose thermal conductivity is 0.42 W/mk or less, is particularly preferable. Specifically, it is preferable to apply the heat insulating coating mold with a thickness of 0.4 mm or more.

(Sand Mold Thin Walled Spherical Graphite Cast Iron)

The above describes the metal mold spherical graphite cast iron. However, the spheroidizing agent according to the present invention is also applicable to a sand mold thin walled spherical graphite cast iron having a thickness of 30 mm or less, which is a solidification cooling condition equivalent to that of the metal mold. Because resin is used for caking sand grains, it cannot be preheated to 200° C. or higher like the metal mold. This is because at 200° C. or higher, the resin decomposes and loses the caking properties of the sand grains. Practically, preheating at about 60° C. is carried out for the purpose of removing moisture. The casting temperature is set to 1,400-1,500° C. from the viewpoint of ensuring molten metal flow. On the other hand, in the green mold, moisture is added to the viscosity to form a sand particle binder, so that it is cast at 1,400-1,500° C. without preheating. For these reasons, in the sand mold casting, although a cooling rate is slightly slower than that of the metal mold casting, the casting conditions are likely to cause chill. The spheroidizing agent of the present invention can also be applied to sand mold casting thin walled spherical graphite cast iron.

EXAMPLES

Example 1

Raw materials such as pig iron, steel scrap, and Fe—Si were blended so as to achieve the following target chemical composition.

(by mass %)

C: 3.60, Si: 2.60, Mn: 0.10, P: 0.025, the rest is Fe

These raw materials were heated and melted in a high frequency induction furnace.

Heating was continued after melting down, 1,425° C. was passed, and heating was also continued. At temperature above 1,425° C., oxygen was removed by CO generation.

When the temperature was further increased, CO generation from the heat-resistant material in the furnace was observed at temperature exceeding 1,510° C. Therefore, the temperature increase was stopped at 1,510° C., and the temperature was kept at 1,510° C. for 5 minutes. During this period, oxygen is efficiently removed from the original molten metal.

After keeping the temperature at 1,510° C. for 5 minutes, it was gradually cooled to 1,425° C. (=T ° C.) at a rate of about 10° C./min. On the way, the temperature was once lowered to 1,440° C., then raised to 1,460° C., and then cooled at the rate of 10° C./min.

An Mg treatment was carried out at 1,425° C. The Mg treatment was carried out based on Fe-50% Si-3% Mg (by mass), by adding the spheroidizing agent containing total nitrogen amount N: 87 ppm, nitrogen amount generated at melting N: 4.5 ppm, and C: 1.5% (by mass).

The inoculation was carried out after the Mg treatment. The molten metal surface was inoculated with 0.6 wt % Fe-75 mass % Si-based inoculum and stirred. The product was a coin with a diameter of 34 mm and a thickness (t) of 5.4 mm. The casting temperature and the metal mold temperature were set as follows.

Also, 0.4 mm of a heat insulating coating mold was applied to the metal mold. The thermal conductivity of the coating mold was 0.42 W/(m·k).

The casting temperature $T_p$ was as follows.

$$T_p=1{,}350\cdot 60M=1{,}320^\circ\ \text{C.}$$

$$M=V/S=0.34$$

V is a product volume ($cm^3$), and S is a product surface area ($cm^2$).

The metal mold temperature $T_d$ was as follows.

$$T_d=470-520M=293^\circ\ \text{C.}$$

The casting in the metal was carried out after 10 seconds from the end of the inoculation, based the casting temperature and the metal mold temperature described above. After the casting, the following results were obtained.

The composition of the product was as follows.

C: 3.61%, Si: 3.11%, Mn: 0.10%, P: 0.024%, S 0.008%, Mg: 0.018%

(by mass)

The amount of nitrogen generated during melting of the die-cast product was 3 ppm (by mass).

A tissue of a sample after casting was observed with a microscopic photograph. A tissue view is shown in FIG. 1A.

The spherical graphite were very fine and uniformly distributed. When the number of spheroidized graphite was counted, the number was 1,963 pieces/$mm^2$. There was no chill generation.

Comparative Example

In the present example, the Mg treatment was carried out by adding Fe—Si-7.5% Mg (N: 250 ppm). The others were the same as in the Example 1.

Result is shown in FIG. 1B.

The spherical graphite were very fine and uniformly distributed. When the number of spheroidized graphite was counted, the number was 760 pieces/$mm^2$. And, many chills were observed.

Example 2

In the present example, the temperature was kept at 1,510° C. for 5 minutes and then gradually cooled to 1,425° C. (=T ° C.) at a rate of about 5° C./min. On the way, the temperature was once lowered to 1,440° C., then raised to 1,460° C., and then cooled at the rate of 5° C./min. The spheroidizing treatment was carried out at 1,425° C.

The nitrogen amount generated during melting of a sand mold casting was 0.7 ppm (by mass).

Figure 2:
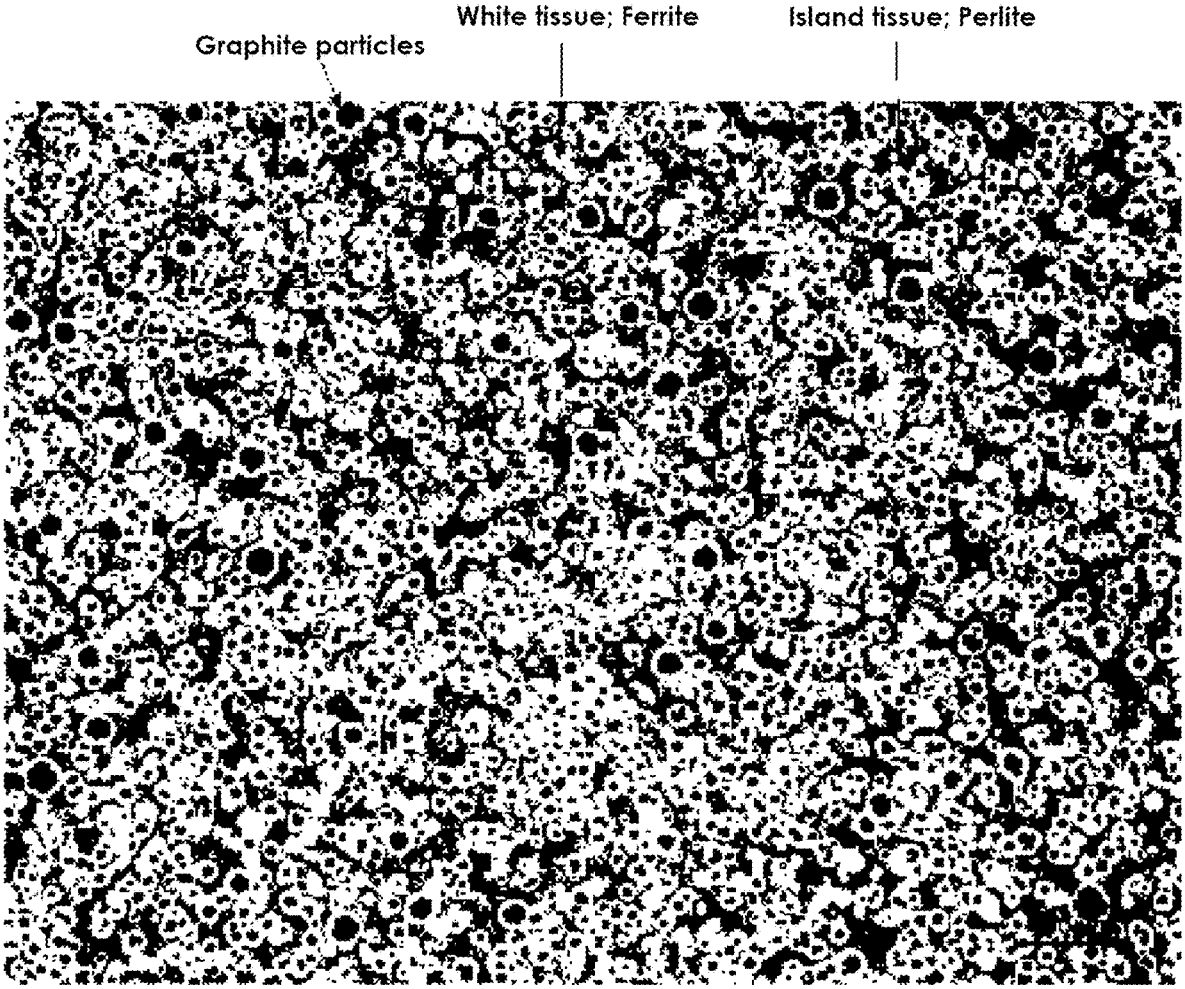
FIG. 2 shows photograph showing a metallographic diagram in Example 2.

Result is shown in FIG. 2. In the present example, 2,605 pieces/mm2 of spherical graphites, which is a larger number of graphite particles than in the Example 1, was observed.

Example 3

An example of sand mold thin walled spherical graphite cast iron is shown. The product was a box casting with an average wall thickness of 6.5 mm and a weight of 125 kg.

Raw materials such as pig iron, steel scrap, and Fe—Si were blended so as to achieve the following target chemical composition.

(by mass %)

C: 3.70, Si: 2.60, Mn: 0.50, P: 0.025. S: 0.035, the rest is Fe

These raw materials were heated and melted in a high frequency induction furnace. After melting down, these were heated to exceed the temperature of 1,425° C., at which the oxygen reduction reaction started by reduction, and also heated to about 1,500° C. and held for 5 minutes.

An Mg treatment was carried out at about 1,500° C. The Mg treatment was carried out based on Fe-50% Si-3% Mg (by mass), by adding the spheroidizing agent containing N: 87 ppm, and C: 1.5% (by mass).

As a cover material for controlling the reaction of the spheroidizing agent, 1% by weight of Fe-75 mass % Si for controlling ingredients was used.

After the Mg treatment, so-called inoculation treatment was not carried out.

The sand mold was formed by a furan self-hardening process, and a general MgO-based coating mold was applied. The casting temperature and the sand mold temperature were set as follows.

The casting temperature: 1,420° C.

The sand mold temperature: no preheating/room temperature

The casting was carried out in the sand mold after 88 seconds from the Mg treatment based on the casting temperature and sand mold temperature described above. The casting time was about 8 seconds. The following results were obtained after the casting.

The chemical composition of the product was as follows.

C: 3.69%, Si: 3.65%, Mn: 0.53%, P: 0.047%, S: 0.017%, Mg: 0.043%

(by mass %)

A tissue of a sample after casting was observed with a microscopic photograph. A tissue view is shown in FIG. 3A.

The spherical graphite were fine and uniformly distributed. When the number of spheroidized graphite was counted, the number was 853 pieces/mm$^2$. There was no chill generation.

Comparative Example

In the present example, the Mg treatment was carried out by adding Fe—Si-7.5% Mg (N: 250 ppm). The others were the same as in the Example 3.

Result is shown in FIG. 3B.

The spheroidal graphite was fine, but had a low spheroidization rate. When the number of spheroidized graphite was counted, the number was 178 pieces/mm2. And, many chills were observed.

What is claimed is:

1. A producing method of a die-cast product of a spherical graphite cast iron comprising following processes sequentially;

a melting process, in which raw material comprising cast iron is melted by heating and an original molten metal is obtained;

a spheroidizing process, in which a spheroidizing is carried out;

an inoculation process, in which an inoculation is carried out; and a casting process, in which a casting in a metal mold is carried out;

wherein the spheroidizing is carried out by using a spheroidizing agent, in which a C amount is 0.5 mass % or more, a total nitrogen amount N is 150 ppm (by mass) or less, and a nitrogen amount generated during melting is 15 ppm (by mass) or less;

wherein the obtained original molten metal is heated to a predetermined temperature of 1,500° C. or higher, heating is then stopped and the original molten metal is hold at the predetermined temperature to remove oxygen from the original molten metal, the original molten metal is cooled to reduce nitrogen in the original molten metal; and then the spheroidizing, the inoculation and the casting are carried out.

2. The producing method of the die-cast product of the spherical graphite cast iron according to claim 1, wherein the spheroidizing agent is a Fe—Si—Mg-based spheroidizing agent.

3. The producing method of the die-cast product of the spherical graphite cast iron according to claim 1, wherein the nitrogen amount generated during melting of the die-cast product is controlled to 5 ppm (by mass) or less.

* * * * *